United States Patent [19]

Hollister et al.

[11] 3,966,051

[45] June 29, 1976

[54] FREE-STANDING GOLF CLUB AND GOLF BALL CARRIER

[76] Inventors: Ralph O. Hollister, 2634 49th Ave. Court; Ernest E. Sanders, 1313 10th St., both of Greeley, Colo. 80631

[22] Filed: Apr. 10, 1975

[21] Appl. No.: 566,723

[52] U.S. Cl. ..... 211/14; 211/60 G; 224/45 L

[51] Int. Cl.[2] ..... A63B 55/02

[58] Field of Search ..... 211/14, 60 G, 49 D; 248/96; 150/1.5 C; 224/45 L, 45 R; 273/32 D, 32 E

[56] References Cited

UNITED STATES PATENTS

| | | | |
|---|---|---|---|
| 1,718,952 | 7/1929 | Fischer | 150/1.5 C |
| 2,091,298 | 8/1937 | Agnew | 211/60 G X |
| 2,881,925 | 4/1959 | Idoux | 211/60 G |
| 2,990,865 | 7/1961 | Steele | 224/45 R UX |
| 3,164,185 | 1/1965 | Ingoldt | 211/60 G X |
| 3,164,393 | 1/1965 | Upham | 211/60 G X |
| 3,353,838 | 11/1967 | Schmid | 224/45 R X |
| D222,720 | 12/1971 | Lapham et al. | 224/45 R |

*Primary Examiner*—James T. McCall
*Assistant Examiner*—Robert W. Gibson, Jr.
*Attorney, Agent, or Firm*—Edwin L. Spangler, Jr.

[57] ABSTRACT

This invention relates to a carrying device for golf clubs and balls characterized by a rigid centerpost alongside which are grouped a plurality of tubes in parallel bundle-forming relation, two of these tubes being springable and cooperating with one another and with the centerpost to define a cage-like compartment for golf balls. The carrier also includes a stake to be driven into the ground projecting from the bottom and a footrest projecting to one side cooperating with the stake to produce a spiked stand.

4 Claims, 6 Drawing Figures

FREE-STANDING GOLF CLUB AND GOLF BALL CARRIER

The price of land and the tremendous expense associated with building and maintaining a full length 18 hole golf course has become so high that more and more so-called "par 3" courses are being built. A full set of clubs is not needed on such courses under most ciucumstances as the distance from tee to green on all the holes is usually less than 200 yards which can be driven with an iron by most average golfers including women although the "short-hitters" may take one wood along to use as a driver. Not infrequently, even the golfers playing the full length 9 or 18-hole courses prefer to take along only a half dozen or so clubs and leave the rest at home or in their locker. It is for such golfers that the present invention is designed, namely, those who wish to carry less than a full complement of clubs along with a few balls in the most convenient way possible.

An ordinary golf bag, even the lightweight canvas ones, is not the answer because they weigh almost as much as the clubs. Full-size leather and vinyl bags are even worse, obviously, and one might just as well bring along the rest of the clubs. Pull carts lessen the burden on the golfer as far as moving the clubs down the fairway from tee to green; however, on most courses, the ground rules are such that the carts must be left a good way from the green, traps and surrounding area. As a result, the effort saved in not having to carry the bag is oftentimes lost having to walk back and forth to get another club or to retrieve the cart preparatory to moving on to the next tee.

It has now been found in accordance with the teaching of the instant invention that these and other problems associated with trying to play golf with less than a full complement of clubs can, in large measure, be overcome by the simple, yet unobvious, expedient of fastening together a few, say seven or so, lightweight plastic tubes in bundle-like fashion without encasing them in any bag-forming outer cover while, at the same time, providing thr assembly with at least two springable tubes and arranging them relative to one another and to a third element of the carrier such that all three cooperate to produce a cage-like compartment for golf balls. The shafts of the clubs are individually housed in separate tubes but, in addition, they remain upright and readily accessible at all times due to the inclusion of a spiked stand on the bottom that will maintain the carrier in free-standing condition wherever it is driven into the ground. Furthermore, the single spike-mark left by the stake is inconsequential except on the green itself or surrounding "frog-hair" which permits the golfer to have his clubs either right alongside or at least readily available at all times.

It is, therefore, the principal object of the present invention to provide a novel and improved carrier for golf balls and golf clubs.

A second objective is the provision of a device of the type aforementioned which includes a spiked stand that maintains same in a free-standing condition even when full of clubs.

Another object of the invention herein disclosed and claimed is to provide the carrier with a cage-like golf ball compartment that need not be opened and reclosed in the usual sense in which these terms are used each time the golfer wishes to withdraw or replace a ball.

Still another object is to supplement the spike stand with a footrest to assist the user in driving the stake into the ground.

An additional object is to provide a club and ball-carrying device for golfers that can, with minor modification be adapted for short or long-shafted clubs, different members thereof, the smaller English ball and other variations of a similar nature.

Further objects are to provide a golf club and ball carrier that is lightweight, inexpensive, rugged, versatile, easy to use and decorative in appearance.

Other objects will be in part apparent and in part pointed out specifically hereinafter in connection with the description of the drawings that follows, and in which.

Figure 1:
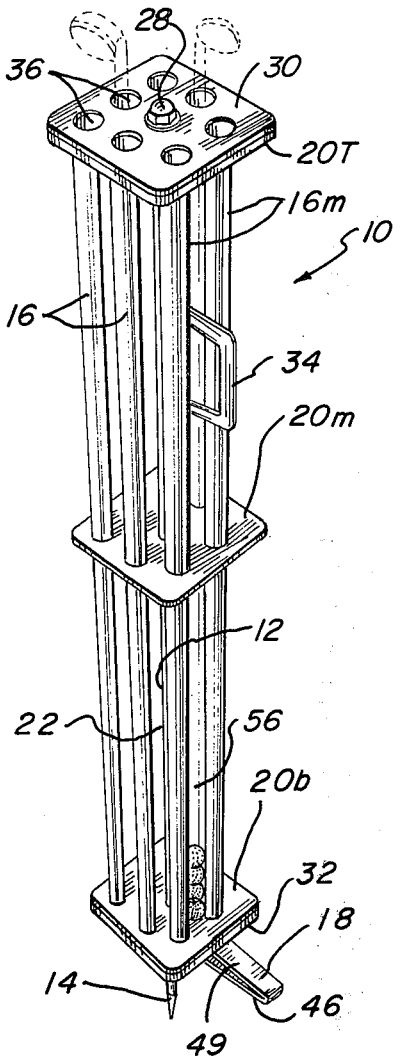
FIG. 1 is a perspective view looking down and to the right upon the golf club and ball carrier.
Figure 2:
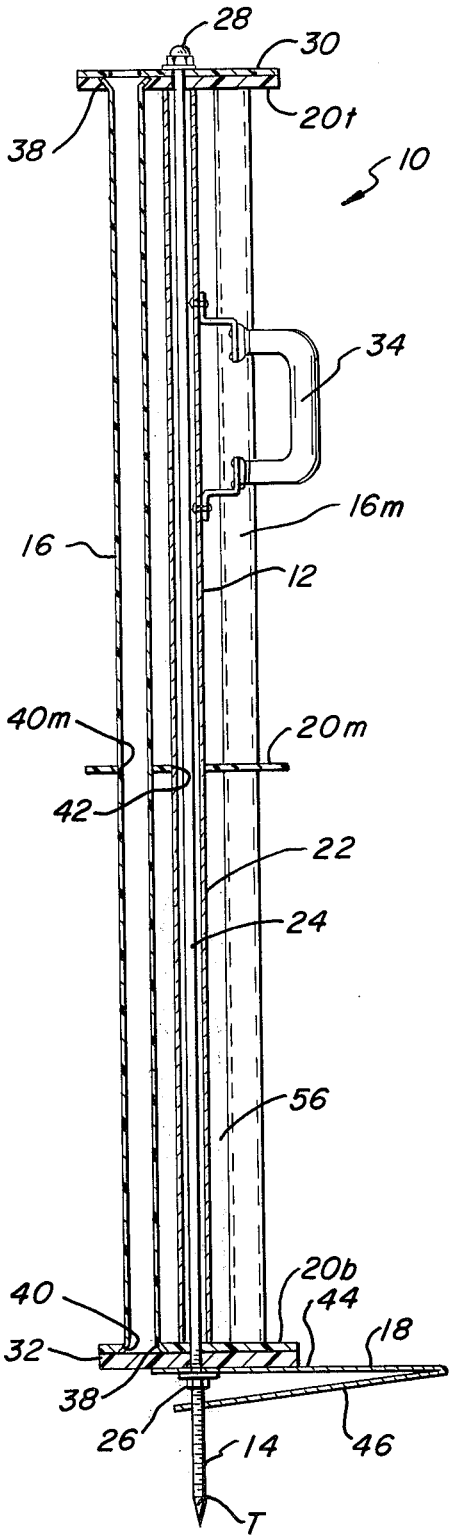
FIG. 2 is a longitudinal half section to the same scale.
Figure 3:
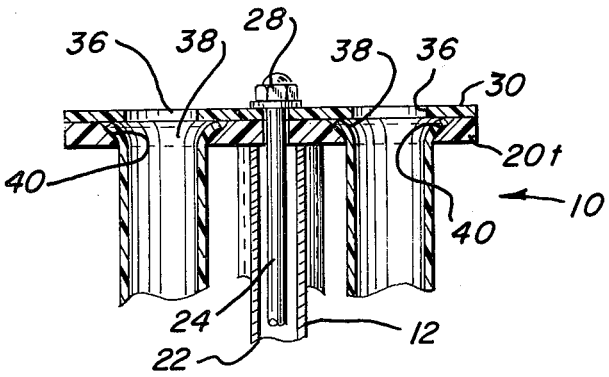
FIG. 3 is a fragmentary section to an enlarged scale showing the top of the unit in detail.

Referring next to the drawings for detailed description of the present invention and, initially, to FIGS. 1, 2 and 3 for this purpose, reference numeral 10 has been used to broadly designate the golf club and ball carrier which will be seen to include amoung other features to be described presently, a centerpost subassembly 12 terminating at its lower end in a stake 14 adapted to be driven into the ground, a plurality of tubes 16 grouped in bundle-forming relation around the centerpost subassembly, a footrest 18 for use in driving the stake into the ground, and apertured plates 20 functioning to maintain the tubes in fixed spaced parallel relationship to one another and to the centerpost subassembly. In the particular form shown, centerpost subassembly 12 comprises a rigid tube 22 housing rod 24 that extends the full length thereof and terminates at its lower end in stake 14, the tip "T" of which is sharpened as shown in FIGS. 1 and 2 for insertion into the ground. This stake-defining portion 14 of rod 24 is threaded to accept nut 26 (FIG. 2) which holds the footrest 18 in place thereon. The head 28 atop the rod cooperates with nut 26 to squeeze the tubes 16 between upper and lower endplates 30 and 32, respectively, that hold the several elements in assembled relation.

Tubular element 22 of cneterpost subassembly 12 could, conceivably, be done away with in favor of the use of rod 24 by itself; however, the tube and rod cooperate to define a much more rigid assembly than either would produce alone. Also, tube 22 acts as a spacer holding the endplates in fixed-spaced relation to one another better than tubes 16 which are preferably made of plastic and, therefore, bendable to a far greater degree. Furthermore, tube 22 facilitates the mounting of carrying handle 34 which, otherwise, would be somewhat more difficult to attach to rod 22.

Lower endplate 32 is solid and defines a closure for the lower ends of the tubes. The grip-end of the golf club shafts rest upon this plate leaving the club heads shown in phantom lines in FIG. 1 to project above the top endplate 30 as shown. While the clubheads would keep the shafts from falling all the way through the bottom of the tubes even if the lower ends thereof were not closed, this is unsatisfactory as the clubs are of different lengths and the tubes would have to be cut to accommodate the longest shafted club letting the shorter ones terminate above the open bottom ends of the tubes. While this could, obviously, be done, it is awkward and closing the lower ends of each tube is by far the better solution.

Upper endplate 30 must, of course, be provided with openings 36 registering with the upper open ends of the tubes 16 so that the club shafts can be inserted therein. In FIGS. 2 and 3 it will be seen that the upper tube ends are fluted or flared slightly as shown at 38 so that they rest against the underside of the top endplate without passing through the openings 36 therein. The upper spacer plate 20*t* that fits snugly up against the underside of top endplate 30 has chamfered openings 40 therein that receive these flared tube ends as shown. In actual practice, spacer plate 20*t* and upper endplate 30 are fastened together to form a laminate as are the lower endplate 32 and the bottom spacer plate 20*b*.

The lower ends of the tubes are flared in the same way as the upper ends and they have been similarly designated by the same reference numeral 38 in FIG. 2 which is the only figure in which this feature shows. The openings in plate 20*b* are chamfered also and carry reference numeral 40 in a like manner to the chamfered openings in plate 20*t*.

Middle spacer plate 20*m* contains an extra hole 42 in the center to pass the centerpost subssembly 12. The tube-receiving holes 40*m* therein differ from apertures 40 in spacer plates 20*t* and 20*b* in that they are not chamfered, at least they do not need to be. This middle plate 20*m* might actually be done away with as its main functional significance is to cooperate with the centerpost subassembly 12 to provide support for the bendable plastic tubes 16 intermediate their ends.

Footrest 18 comprises nothing more than a tongue of strap metal bent back upon itself in more or less of a V-shape so that the legs thereof do not parallel one another. As such, with the upper leg 44 drawn up snug against the underside of endplate 32 by nut 26, the lower leg 46 will slant downwardly in brace-forming relation to said upper leg. Both legs are, of course, provided with suitable apertures 48 to receive the stake 14.

Figure 4:
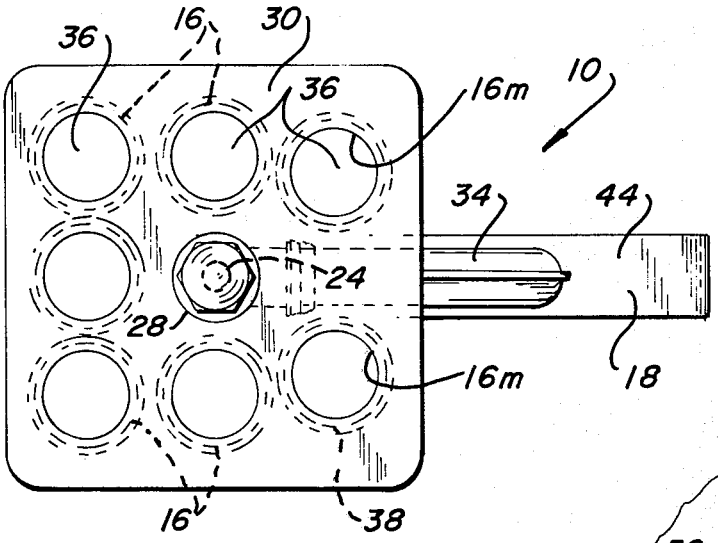
FIG. 4 is a top plan view of the carrier to the same scale as FIG. 3.
Figure 6:
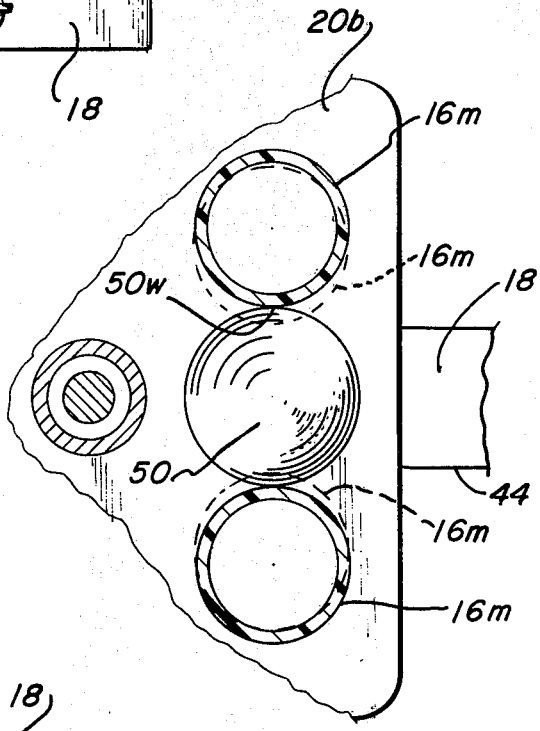
Figure 5:
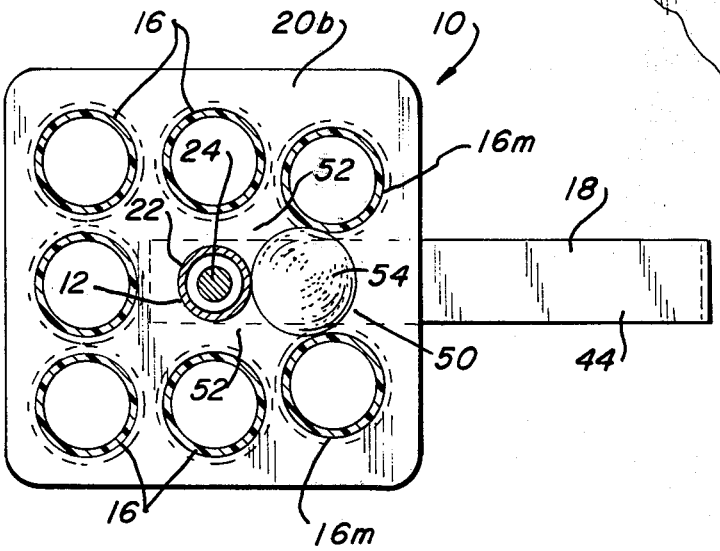
FIG. 5 is a transverse section taken between the lower and middle plates that hold the tubes in fixed spaced parallel relation to one another, the scale being the same as that of FIGS. 3 and 4; and, FIG. 6 is a fragmentary transverse section like FIG. 5 except that it shows a pair of the tubes spread apart to pass a golf ball therebetween.

Next, with reference to FIGS. 4, 5 and 6 in particular, it will be seen that two of the tubes 16m are are spaced apart a distance such that the gap 50 left therebetween and the gap 52 between each of them and the centerpost subassembly 12 is just slightly less than the diameter of a golf ball 54. Also, while all the tubes 16 need not necessarily be this way, at least tubes 16m must be springable to the extent required to spread them apart and pass the golf ball through the widended gap 50*w* thus formed, all of which is most clearly revealed in FIG. 6.

Tubes 16*m* cooperate with one another, the centerpost subassembly 12 and spacer plates 20*m* and 20*b* to define a cage-like compartment 56 for golf balls. Actually, a similar compartment also exists between the middle spacer plate 20*m* and upper spacer plate 20*t* except that the latter compartment is at least partially obstructed by handle 34. There is ample space provided in compartment 56 to carry 10 to a dozen golf balls which is generally adequate. As previously noted, all of the tubes 16 are advantageously alike and, therefore, springable to the same degree as tubes 16*m;* however, it is only the latter pair in which this capability is important functionally.

What is claimed is:

1. In a carrier for both golf clubs and golf balls: a pair of elongate springable tubular elements having the interior thereof sized to loosely receive the shaft of a golf club, a third elongate element, and means fastened to said third element and said pair of tubular elements fastening them together in spaced parallel relation to one another while cooperating therewith to define a cage-like compartment closed at both ends and sized to retain a plurality of golf balls stacked one atop another, said pair of tubular elements being held in spaced relation such that the normal gap separating them is less than the diameter of a golf ball, and said tubular elements being spreadable to the extent necessary to pass a golf ball therebetween.

2. The carrier of claim 1 in which: the third elongate element comprises a rigid rod.

3. The carrier of claim 1 in which: the means fastening the tubular elements and third element together comprises a pair of plates arranged in longitudinally spaced substantially parallel relation to one another.

4. The carrier of claim 3 in which: one of said plates comprises a cap closing the lower ends of the tubular elements.

* * * * *